US005785320A

United States Patent [19]

Borg

[11] Patent Number: 5,785,320

[45] Date of Patent: Jul. 28, 1998

[54] CUBIC ALIGNMENT GAME

[76] Inventor: Christopher Borg, 720 14th, Huntington Beach, Calif. 92648

[21] Appl. No.: 850,342

[22] Filed: May 2, 1997

[51] Int. Cl.[6] ..... A63F 3/00

[52] U.S. Cl. ..... 273/241; 273/271; 273/280

[58] Field of Search ..... 273/241, 264, 273/271, 280, 153 S

[56] References Cited

U.S. PATENT DOCUMENTS

| | | | |
|---|---|---|---|
| 2,886,325 | 5/1959 | Long | 273/241 X |
| 3,930,651 | 1/1976 | Rades | 273/241 |
| 4,009,882 | 3/1977 | Rades | 273/241 X |
| 4,129,303 | 12/1978 | Flagg | 273/280 X |
| 4,437,667 | 3/1984 | Milles | 273/241 X |
| 4,440,395 | 4/1984 | Hyland et al. | 273/271 X |
| 4,535,993 | 8/1985 | Topits | 273/241 |
| 4,552,362 | 11/1985 | Oake | 273/280 X |
| 4,925,194 | 5/1990 | Anderson | 273/271 |
| 5,433,448 | 7/1995 | Raphael et al. | 273/271 X |
| 5,613,681 | 3/1997 | Allen | 273/271 |

FOREIGN PATENT DOCUMENTS

| | | | |
|---|---|---|---|
| 3116973 | 11/1982 | Germany | 434/128 |

*Primary Examiner*—William E. Stoll

[57] ABSTRACT

A 3-dimensional, token alignment game which can be played by 2 or 3 people and consists of a 6 sided game box inset with 96 small, rotatable, cube shaped game pieces and a detachable, rotatable base. The 96 game pieces are all identical, each having 4 different colored sides and a shaft through the center which is parallel to the colored sides of the game piece. The shafts are inset into the sides of the game box and they allow each game piece to be turned so that only one of the colored sides of the game piece is visible from the outside of the game box. At the start of a game all 96 game pieces are positioned so that only the same, single neutral color is visible on each game piece. Each player then chooses one of the remaining colors as their own. In succession each player turns one neutral colored game piece so that that game piece shows only their color. This procedure is repeated until a player manages to get 5 of their color game pieces in a consecutive horizontal, vertical or diagonal line. The base consists of 2 disk shaped sections connected by a bearing and 2 "L" shaped legs that connect the base to the game box. When the base is attached, the game box can be rotated around a vertical and horizontal axis.

6 Claims, 6 Drawing Sheets

FIG. 34
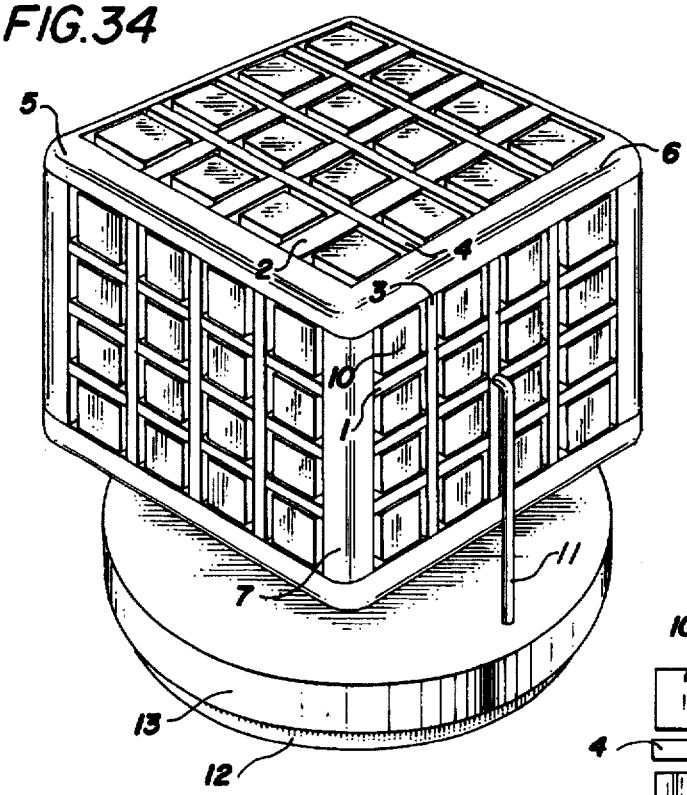
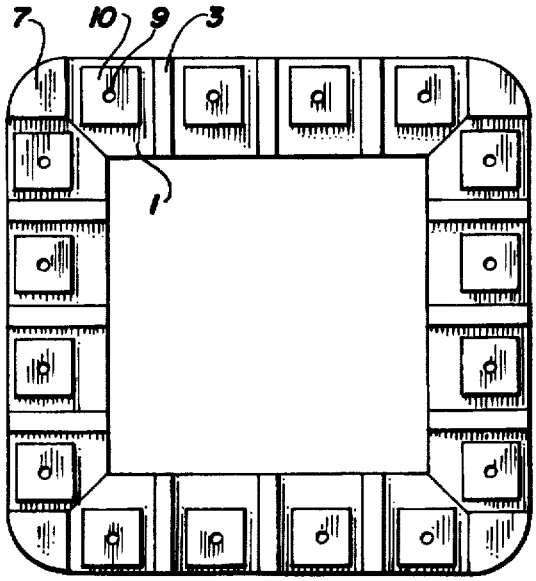
FIG. 23
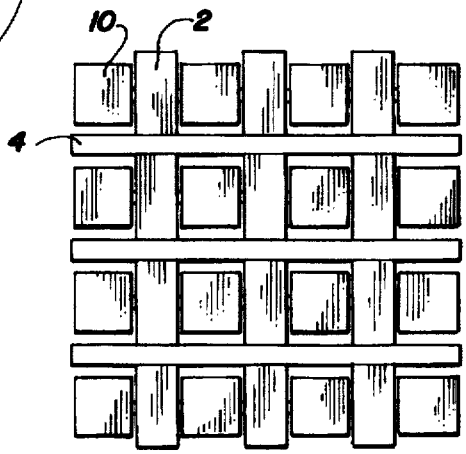
FIG. 24
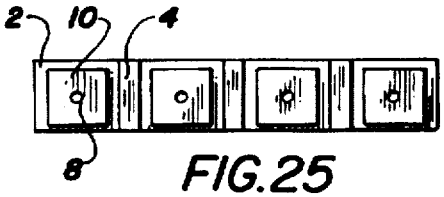
FIG. 25
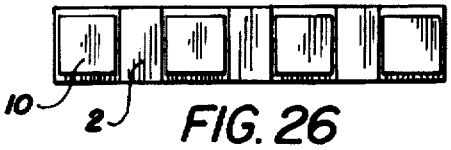
FIG. 26

CUBIC ALIGNMENT GAME

TITLE OF THE INVENTION

A 3-dimensional, token alignment game which can be played by 2 or 3 people and consists of a 6 sided game box inset with 96 small, rotatable, 4 colored, cube shaped game pieces and a detachable, rotatable base.

BRIEF SUMMARY OF THE INVENTION

A 3-dimensional, token alignment game which can be played by 2 or 3 people and consists of a 6 sided game box inset with 96 small, rotatable, cube shaped game pieces and a detachable, rotatable base. The 96 game pieces are all identical, each having 4 different colored sides and a shaft through the center which is parallel to the colored sides. The shafts are inset into the sides of the game box, 4 shafts per side, and they allow each game piece to be positioned so that only one of its colored sides is visible from the outside of the box. The game begins with all the game pieces positioned to show the same single neutral color. Each player then picks one of the remaining colors as their own. In order, each player then turns one neutral colored game piece so that that game piece shows only their color. This procedure is repeated until a player manages to align 5 of their color pieces in a consecutive horizontal, vertical or diagonal line.

BRIEF DESCRIPTION OF THE SEVERAL VIEWS OF THE DRAWING

FIG. 23 is a top view of the four identical size sides of the game box connected together with the end moldings of FIG. 13 attached.

FIG. 24 is a front view of an assembled version of one of the two identical size sides of the game box.

FIG. 25 is an end view of FIG. 24.

FIG. 26 is an adjacent end view of FIG. 25.

FIG. 34 is a 3-dimensional view of the fully assembled game box with the base attached.

DETAILED DESCRIPTION OF THE INVENTION

Figure 19:
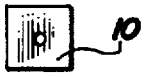
FIG. 19 is an end view of a game piece that is positioned as shown in FIG. 34. There are a total of ninety-six of these game pieces.
Figure 20:
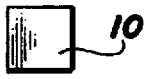
FIG. 20 is a side view of FIG. 19.
Figure 16:
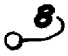
FIG. 16 is an end view of FIG. 15.
Figure 35:
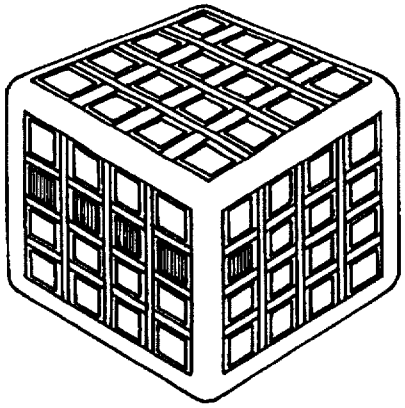
FIG. 35 is a 3-dimensional view of the game box without the base. The shaded game pieces illustrate one way the game can be won with five consecutive identical color game pieces aligned horizontally.
Figure 36:
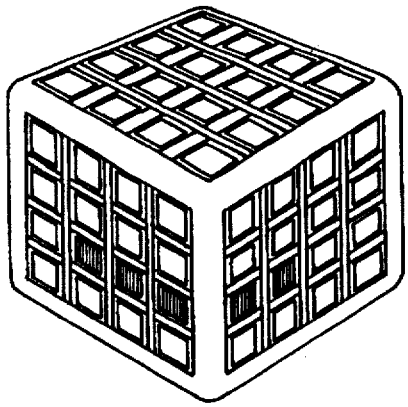
FIG. 36 is identical to FIG. 35 except that it illustrates another winning horizontal line.
Figure 37:
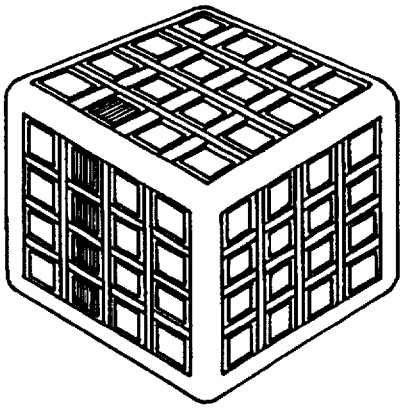
FIG. 37 is identical to FIG. 35 except it illustrates one way the game can be won with five consecutive identical color game pieces aligned vertically.
Figure 38:
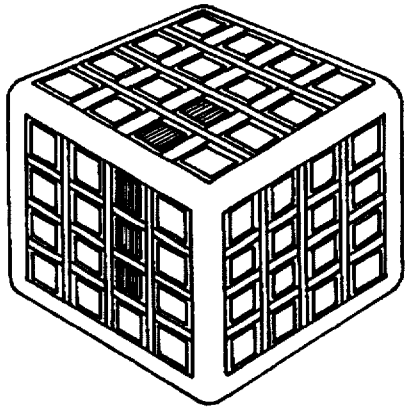
FIG. 38 is identical to FIG. 37 except it illustrates another winning vertical line.
Figure 39:
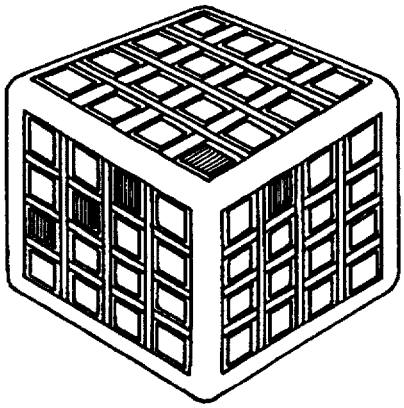
FIG. 39 is identical to FIG. 35 except it illustrates one way the game can be won with five consecutive identical color game pieces aligned diagonally.
Figure 40:
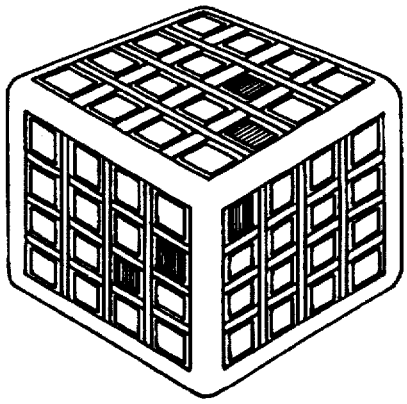
FIG. 40 is identical to FIG. 39 except it illustrates another winning diagonal line.

Referring to FIG. 34, a 3-dimensional, token alignment game which can be played by 2 or 3 people and consists of: a 6 sided game box, 96 rotatable game pieces and a detachable, rotatable base. FIG. 19 and FIG. 20 show a game piece. The 96 game pieces are inset into the sides of the box, 16 game pieces per side. All the game pieces are identical, each having 4 different colored sides, (white, black, red, green), and a hole through the center which is parallel to the colored sides. Each game piece is attached to the box by a game piece shaft shown in FIG. 15 and FIG. 17. There are 4 parallel game piece shafts inset into each side of the game box as shown in FIG. 23 and FIG. 25. Each game piece can be rotated around its shaft and positioned so that only one of its colored sides is visible from the outside of the box. At the start of a game, all 96 game pieces are positioned so that every game piece shows only one color and that color is the same on each game piece. That color becomes the neutral color. The first player then chooses one of the 3 remaining colors as their own. The second player picks one of the 2 remaining colors as their own and if there is a third player, he takes the last remaining color as his own. Following that same order used to choose colors, each player in succession selects one neutral colored game piece and turns it so that that game piece shows only their color. This procedure is repeated until a player manages to align 5 of their color game pieces in a consecutive horizontal, vertical or diagonal line. That player wins the game. FIG. 35 and FIG. 36 illustrate 2 possible ways a horizontal line of 5 consecutive identical colored game pieces can be completed. The shaded game pieces represent one player's color while the unshaded game pieces represent the neutral color game pieces. As illustrated in FIG. 35 and FIG. 36, a total of 5 horizontally adjacent game pieces in 2 adjacent sides of the game box are required to complete the winning horizontal line. That same pattern can be created on any 2 adjacent sides of the game box. FIG. 37 and FIG. 38 illustrate 2 possible ways a vertical line of 5 consecutive identical colored game pieces can be completed. The shaded game pieces represent one players color while the unshaded game pieces represent the neutral color game pieces. As illustrated in FIG. 37 and FIG. 38, a total of 5 vertically adjacent game pieces in 2 adjacent sides of the game box are required to complete the winning vertical line. That same pattern can be created on and 2 adjacent sides of the game box. FIG. 39 and FIG. 40 illustrate 2 possible ways a diagonal line of 5 consecutive identical colored game pieces can be completed. Once again the shaded game pieces represent one player's color while the unshaded game pieces represent the neutral color game pieces. As illustrated in FIG. 39 and FIG. 40, a total of 5 diagonally adjacent game pieces in 3 adjacent sides of the game box are required to complete the winning diagonal line. That same pattern can be created on any 3 adjacent sides of the game box.

Figure 1:
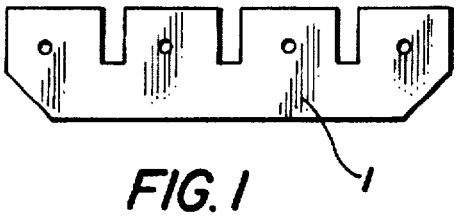
FIG. 1 is a front view of a cross member of the four identical size sides of FIG. 21 and FIG. 22. There are a total of twelve of these cross members.
Figure 2:
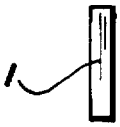
FIG. 2 is an end view of FIG. 1.
Figure 3:
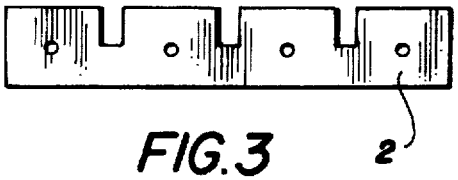
FIG. 3 is a front view of a cross member of the two identical size sides of FIG. 24. There are a total of six of these cross members.
Figure 4:
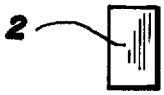
FIG. 4 is an end view of FIG. 3.
Figure 5:
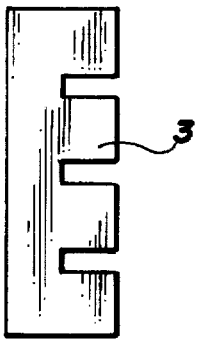
FIG. 5 is a front view of a cross member of the four identical size sides of FIG. 21 and FIG. 22. There are a total of twelve of these cross members.
Figure 6:
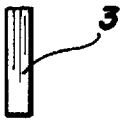
FIG. 6 is an end view of FIG. 5.
Figure 7:
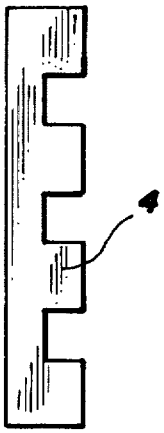
FIG. 7 is a front view of a cross member of the two identical size sides of FIG. 24. There are a total of six of these cross members.
Figure 8:
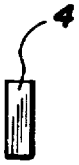
FIG. 8 is an end view of FIG. 7.
Figure 9:
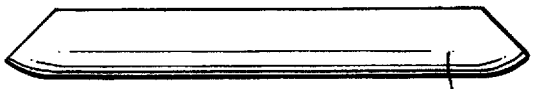
FIG. 9 is a front view of an edge molding that is positioned as shown in FIG. 27. There are a total of four of these edge moldings.
Figure 10:
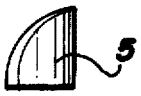
FIG. 10 is an end view of FIG. 9.
Figure 11:
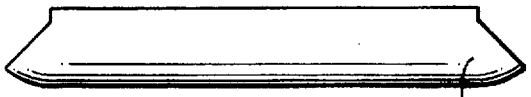
FIG. 11 is a front view of an edge molding that is positioned as shown in FIG. 27. There are a total of four of these edge moldings.
Figure 12:
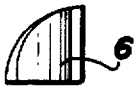
FIG. 12 is an end view of FIG. 11.
Figure 13:
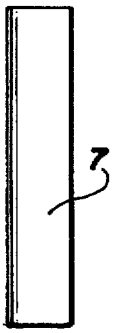
FIG. 13 is a front view of an edge molding that is positioned as shown in FIG. 23. There are a total of four of these edge moldings.
Figure 14:
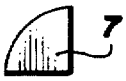
FIG. 14 is an end view of FIG. 13.
Figure 15:
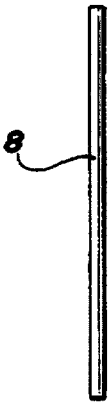
FIG. 15 is a front view of a game piece shaft that is positioned as shown in FIG. 25. There are a total of eight of these game piece shafts.
Figure 18:
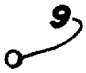
FIG. 18 is an end view of FIG. 17.
Figure 17:
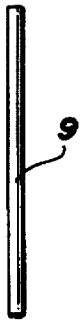
FIG. 17 is a front view of a game piece shaft that is positioned as shown in FIG. 23. There are a total of sixteen of these game piece shafts.
Figure 21:
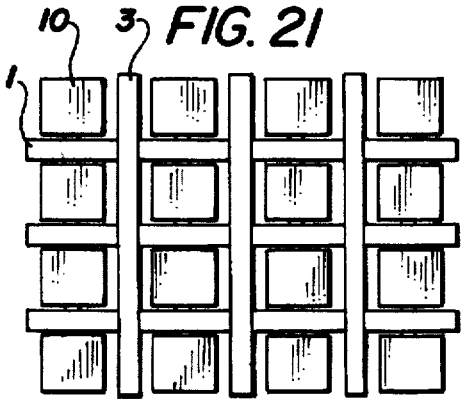
FIG. 21 is a front view of an assembled version of one of the four identical size sides of the game box.
Figure 22:
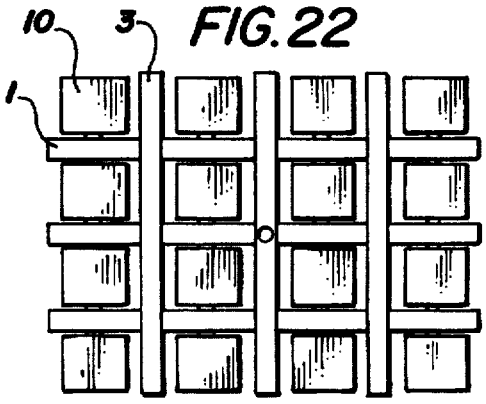
FIG. 22 is identical to FIG. 21 except that it has a hole in the center for the insertion of a base leg. Two opposite sides of the four identical size sides of the game box have those holes.
Figure 33:
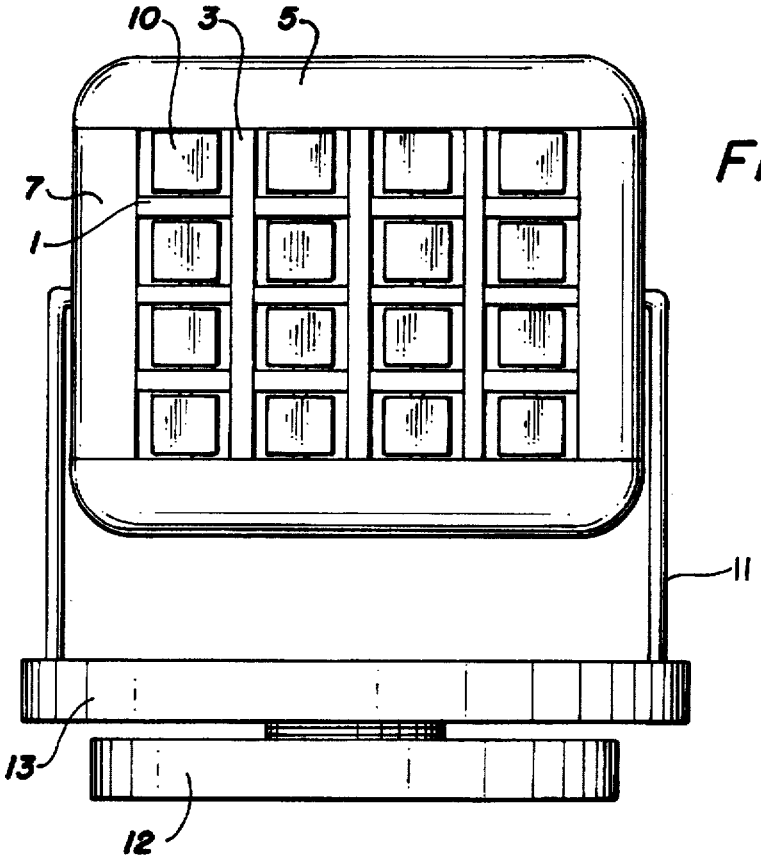
FIG. 33 is a 2-dimensional front view of the game box fully assembled with the base attached.
Figure 27:
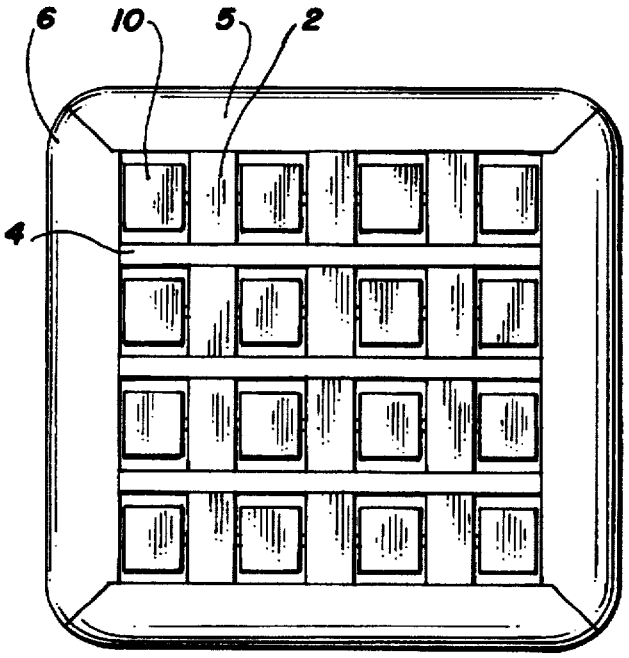
FIG. 27 is a front view of one of the two identical size sides fully assembled with the edge moldings of FIG. 9 and FIG. 11 attached.
Figure 29:
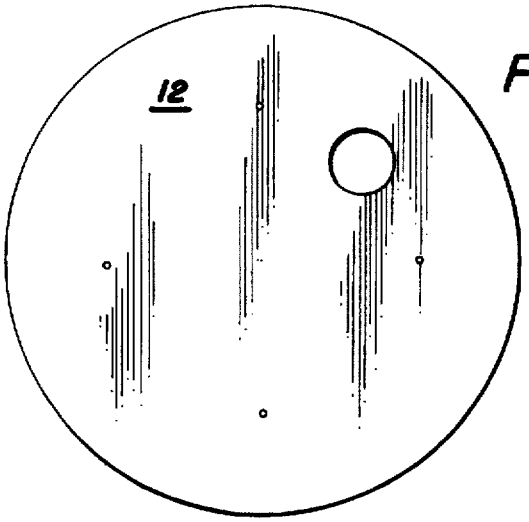
FIG. 29 is a top view of the bottom section of the base.
Figure 28:
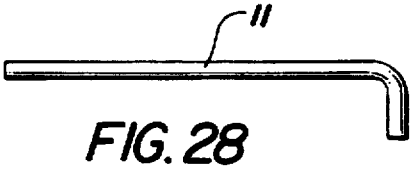
FIG. 28 is a front view of a base leg. The base legs connect the game box to the base. There are two base legs.
Figure 30:
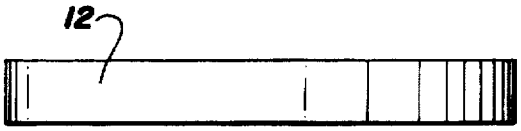
FIG. 30 is an edge view of FIG. 29.
Figure 31:
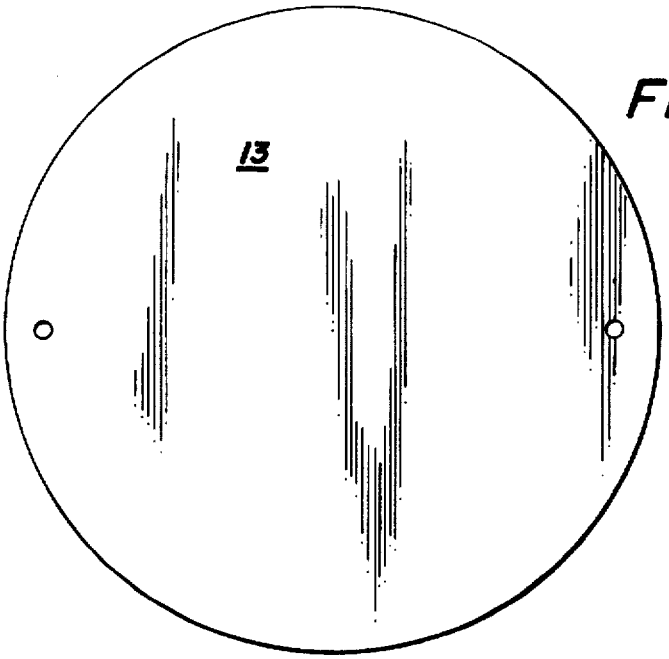
FIG. 31 is a top view of the top section of the base. The two holes shown in the top section are for the insertion of the base legs of FIG. 28.
Figure 32:
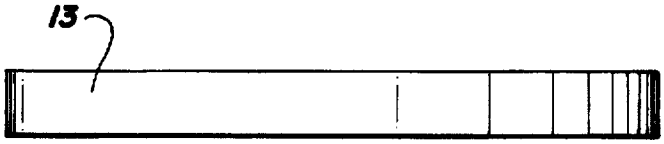
FIG. 32 is an edge view of FIG. 31.

This paragraph describes the construction of the invention. Glue is spread in all of the slots of three of the FIG. 1 cross members and three of the FIG. 5 cross members. The six cross members are then fit together so that FIG. 1 and FIG. 5 cross members are perpendicular and their slots slide into each others. Sixteen game pieces of FIG. 19 are placed in the openings between the assembled cross members so that the identical colored sides of every game piece all have the same orientation. Four game piece shafts of FIG. 17 are pushed through the holes in the game pieces and the FIG. 1 cross members to create a fully assembled side as shown in FIG. 21. The procedure described above is repeated to create three more sides, for a total of four identical size sides. Two of those sides have a hole in the middle of the cross member of FIG. 1 as shown in FIG. 22. Glue is then spread on the ends of all the FIG. 1 cross members and the four identical size sides of FIG. 21 and FIG. 22 are fit together so that the adjacent FIG. 1 cross members of each side line up with each other and the two FIG. 22 sides are on opposite sides. The four edge moldings of FIG. 13 are then glued into the outside comers of the four connected sides. This creates the structure shown in FIG. 23. Glue is spread in all of the slots of three of the cross members of FIG. 3 and three of the cross members of FIG. 7. The six cross members are then fit together so that FIG. 3 and FIG. 7 cross members are perpendicular and their slots slide into each others. Sixteen game pieces of FIG. 19 are placed into the openings between the assembled cross members so that the identical colored sides of every game piece all have the same orientation. Four game piece shafts of FIG. 15 are pushed through the holes in the FIG. 19 game pieces and the FIG. 3 cross members to create a fully assembled side as shown in FIG. 24. This procedure is repeated to create one more side, for a total of two of these identical size sides. Glue is then spread on the ends of all the cross members of the two FIG. 24 sides and then the edge moldings of FIG. 9 and FIG. 11 are pressed into place along the sides of two FIG. 24 sides to create two FIG. 27 identical size sides. Glue is then spread on the bottom sides of the edge moldings of FIG. 9 and FIG. 11 on the two FIG. 27 sides. One FIG. 27 assembly is pressed into place on the open top end of FIG. 23 and the other FIG. 27 assembly is pressed into place on the open bottom end of FIG. 23. That completes the construction of the game box as shown in FIG. 35. As illustrated in FIG. 33 and FIG. 34 the game box has a base. FIG. 29 and FIG. 31 show the two disk shaped sections of the base. These two sections are connected together by a "Lazy Susan" bearing. FIG. 28 shows a base leg. There are two base legs and they connect the base to the game box. To connect the base to the game box, the short end of an "L" shaped base leg of FIG. 28 is inserted into the hole shown in the center of FIG. 22. The short end of the other FIG. 28 base leg is then inserted into the center hole of the opposite side of the game box. The long ends of the two FIG. 28 base legs are then inserted into the two holes in the top section of the base shown in FIG. 31. The base can be detached from the game box by reversing the procedure described above. When the base is attached to the game box, the game box can be rotated around a vertical and horizontal axis.

While there has been shown and described a preferred embodiment of the 3-dimensional token alignment game of this invention, it is understood that changes in structure, materials, sizes, shapes and colors can be made by those skilled in the art without departing from the invention. The invention is define in the following claims.

I claim:

1. A 3-dimensional, token alignment game, playable by 2 or 3 people, comprising: 96 small, individually rotatable, cube shaped game pieces which have 4 different colored sides, that are inset in and attached to the 6 sides of a single large cube which has a rotatable base which is also detachable.

2. The 3-dimensional, token alignment game of claim 1 wherein: said large cube has edge moldings along all 12 edges and has 6 sides, each side consisting of: 6 interlocking cross members which form a grid, 4 game piece shafts that are parallel to each other and run through the center of each grid opening, and 16 game pieces that are inset into the grid openings and centered on the game piece shafts.

3. The 3-dimensional, token alignment game of claim 1 wherein: said game pieces are all identical with each having 4 different colored sides and a hole in the center which is parallel to the colored sides of the game piece and through which a game piece shaft is inserted, thus allowing the game piece to be turned so that only one of its colored sides is visible from the outside of the large cube.

4. The 3-dimensional, token alignment game of claim 1 wherein: said game pieces are all positioned so that only the same single neutral color is visible at the start of a game and then each player in succession repositions one neutral color game piece so that that game piece shows only the color assigned to them, with that process being repeated until a player manages to align 5 of their color game pieces in a consecutive horizontal, vertical or diagonal line.

5. The 3-dimensional, token alignment game of claim 4 wherein: said consecutive horizontal line requires the use of 5 horizontally consecutive game pieces in 2 adjacent sides of the large cube, said consecutive vertical line requires the use of 5 vertically consecutive game pieces in 2 adjacent sides of the large cube and said consecutive diagonal line requires the use of 5 diagonally consecutive game pieces in 3 adjacent sides of the large cube.

6. The 3-dimensional, token alignment game of claim 1 wherein: said rotatable, detachable base consists of an upper and lower disk shaped section connected by a bearing, and 2 "L" shaped connecting legs whose ends fit into holes in the upper base section and said large cube, thus allowing said large cube to be rotated around a vertical and horizontal axis.

* * * * *